US005176295A

United States Patent [19]

Stefanik

[11] Patent Number: 5,176,295

[45] Date of Patent: Jan. 5, 1993

[54] DISCHARGE APPARATUS FOR BINS

[75] Inventor: Paul Stefanik, Anjou, Canada

[73] Assignee: Beloit Technologies, Inc., Wilmington, Del.

[21] Appl. No.: 798,984

[22] Filed: Nov. 29, 1991

Related U.S. Application Data

[63] Continuation of Ser. No. 495,814, Mar. 13, 1990, abandoned.

[51] Int. Cl.[5] ..... G01F 11/00

[52] U.S. Cl. ..... 222/271; 222/281

[58] Field of Search ..... 222/236–242, 222/410, 412, 413, 271, 272, 280, 281, 216, 217, 264, 367, 459, 142; 366/297–301

[56] References Cited

U.S. PATENT DOCUMENTS

| | | | |
|---|---|---|---|
| 2,676,694 | 4/1954 | Wyss et al. | 222/271 X |
| 2,688,393 | 9/1954 | Uschmann | 222/271 X |
| 3,145,882 | 8/1964 | Quackenbush | 222/271 X |
| 3,386,705 | 6/1968 | Griffin | 366/299 X |
| 3,512,683 | 5/1970 | Frisbie | 222/271 X |
| 3,613,953 | 10/1971 | Paules | 222/271 X |
| 3,933,086 | 1/1976 | Standing | 222/272 X |
| 4,189,240 | 2/1980 | Scheppele | 366/297 X |
| 4,284,358 | 8/1981 | Sato et al. | 366/297 X |
| 4,363,341 | 12/1982 | Powell | 222/281 X |
| 4,504,182 | 3/1985 | Burkner | 222/281 X |

FOREIGN PATENT DOCUMENTS

| | | | |
|---|---|---|---|
| 0655422 | 4/1979 | U.S.S.R. | 366/297 |

*Primary Examiner*—Andres Kashnikow
*Assistant Examiner*—Kenneth DeRosa
*Attorney, Agent, or Firm*—Dirk J. Veneman; Raymond W. Campbell; Gerald A. Mathews

[57] ABSTRACT

A discharge apparatus for use in bins or hoppers in which a pluraity of rolls are disposed in a lower portion of the bin, and are so arranged to inhibit gravitational flow of material between the spaces defined by adjacent rolls. The rolls include knobs, plates, or the like extending outwardly therefrom, and the rolls may be arranged in a single row, or in multiple rows. When the rolls are rotated, material above the rolls is permitted to flow between the rolls and out of the bin or hopper. The rolls may be horizontal, or inclined, and may be variously shaped, including cylindrical, conical, or other geometrically complimentary shapes.

4 Claims, 5 Drawing Sheets

DISCHARGE APPARATUS FOR BINS

This is a continuation of copending application(s) Ser. No. 07/495,814 filed on Mar. 13, 1990 now abandoned.

BACKGROUND OF THE INVENTION i. Technical Field

This invention relates to an apparatus for discharging material contained in bins, and is particularly suitable for metered discharge of the material. More specifically, the invention is advantageously employed for handling nonfree-flowing materials such as wood chips.

ii. Prior Art

Many processes and operations require the storage of materials in bins or hoppers. If the material is nonfree-flowing, apparatus must be provided to extract the material from the bin or hopper. In the past, a number of discharging devices have been used, including screw feeders, chain conveyors, stokers, slat conveyors, and the like. Integrating heretofore known discharge devices with a hopper or bin complicates the overall construction and increases the capital expense for installing storage facilities.

Most previously known discharge apparatus operate substantially horizontally inside the bin or hopper, near the bottom thereof. After the material is carried outside of the bin, it is deposited in a vertical outfeed chute. Often, the floor or base of the bin or hopper is inclined opposite the direction of material flow. When the process requires that the flow or discharge of the material be controlled or metered, a limited opening is often provided through which the material is extruded. The material flow rate is controlled by controlling the size of the opening through which the material is extruded. The horizontal movement of the material, removal along inclines from the bin, and extraction through metering gates requires the expenditure of significant amounts of energy. Energy requirements are even further increased if the material being stored and extracted does not shear easily. High shear forces frequently cause compaction of the material near the metering points, which creates bridging across the bin and results in efficient or nonoperation of the discharging device. If the process in which it is used requires continuous flow from the discharge device, valuable production time is lost while any plugging or bridging is cleared.

SUMMARY OF THE INVENTION

It is, therefore, one of the principle objects of the present invention to provide a discharge apparatus for bins and hoppers which is uncomplicated in construction and operation, thereby facilitating integration of the discharge apparatus with a bin or hopper at minimal expense.

Another object of the present invention is to provide a discharge apparatus for bins or hoppers which induces and controls vertical, gravity enhanced flow of material from the bin, thereby reducing the energy required for extracting the material from the bin.

A further object of the present invention is to provide a discharge apparatus for bins or hoppers which modulates the flow of material from the bin, and which minimizes or prevents compaction and bridging of the material above the discharger.

A still further object of the present invention is to provide an apparatus for discharging nonfree-flowing material from a bin or hopper which is particularly suitable for discharging wood chip wafers, and which can be optimized in structure for the material which will be discharged.

A still further object of the present invention is to provide a discharge apparatus for bins or hoppers which extends across the full width or length of the bin or hopper, and which provides a metered flow of material from the bin or hopper without the use of metering gates, or other restrictive openings.

These and other objects are achieved in the present invention by providing a bin or hopper having a bottom discharge opening across its full length. A plurality of rolls are provided near the bottom of the hopper, and are arranged and configured with respect to the type of material being discharged such that, during rotation, the rolls sift and dislodge material from the bin, allowing the material to fall between and among the rolls and out of the bin or hopper. When the rolls are not being rotated, the opening from the bin is effectively closed by the rolls, thereby preventing additional material from falling out of the bin.

The structure of the rolls, the arrangement of rolls, and the number of rolls used may vary depending upon the material to be stored in and discharged from the bin. For example, smooth or ribbed rolls may be arranged in the discharge area of the hopper, in two or more rows. Normally, lower rolls are positioned in the open area defined by rolls in upper rows. The rolls may have radially extending fins or plates which intermesh with the fins or plates radially extending from adjacent rolls. The rolls may be parallel to or perpendicular to a longitudinal extent of the bin opening. In some applications, it may be particularly advantageous to dispose the rolls angularly in the horizontal, or vertical planes with respect to the discharge opening. In other variations, the rolls are not cylindrical in shape, but may be conical. Still, other variations include rolls formed from staggered cylinders alternately arranged with staggered cylinders from adjacent rolls, or other shapes in which adjacent rolls compliment each other. For example, one roll may be essentially concave in shape, with the adjacent roll being convex.

Additional objects and advantages of the present invention will become apparent from the following detailed description and the accompanying drawings.

DETAILED DESCRIPTION OF PREFERRED EMBODIMENTS

Figure 1:
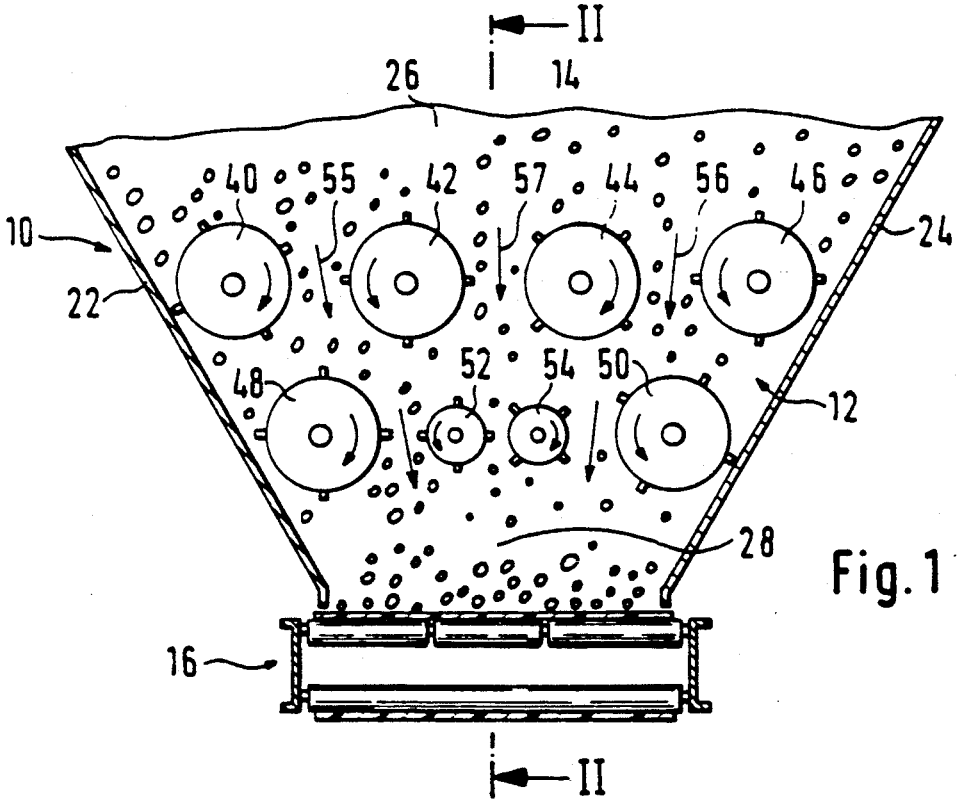
FIG. 1 is a cross-sectional view of the discharge area of a hopper employing a discharge apparatus embodying the present invention.

Referring now more specifically to the drawings, and to FIG. 1 in particular, numeral 10 designates a bin or hopper having disposed therein a discharge apparatus 12 embodying the present invention. Apparatus 12 is provided for effecting a continuous metered discharge of a material 14 to a conveyor 16.

Bin 10 includes parallel vertical walls 18 and 20 defining 2 sides of the bin, and angularly converging walls 22 and 24 disposed between the vertical perpendicular walls. Discharge apparatus 12 is disposed in the lower portion of the bin or hopper 10, and separates the bin into a retention area thereabove, generally indicated by numeral 26, and a discharge area 28 therebelow. It will be understood by those familiar with the art that the size and shape of the bin or hopper 10 may vary. Above the angular walls 22 and 24, bin walls may extend substantially vertically. The bin or hopper may include angular portions on all walls, may include only vertically oriented walls with no angular walls, the walls defining right angles in the corners, may be round or oblong in cross-section thereby defining no corners, or the like. The present discharge apparatus can be adopted for use in any shape bin or hopper, with similarly advantageous results.

Figure 2:
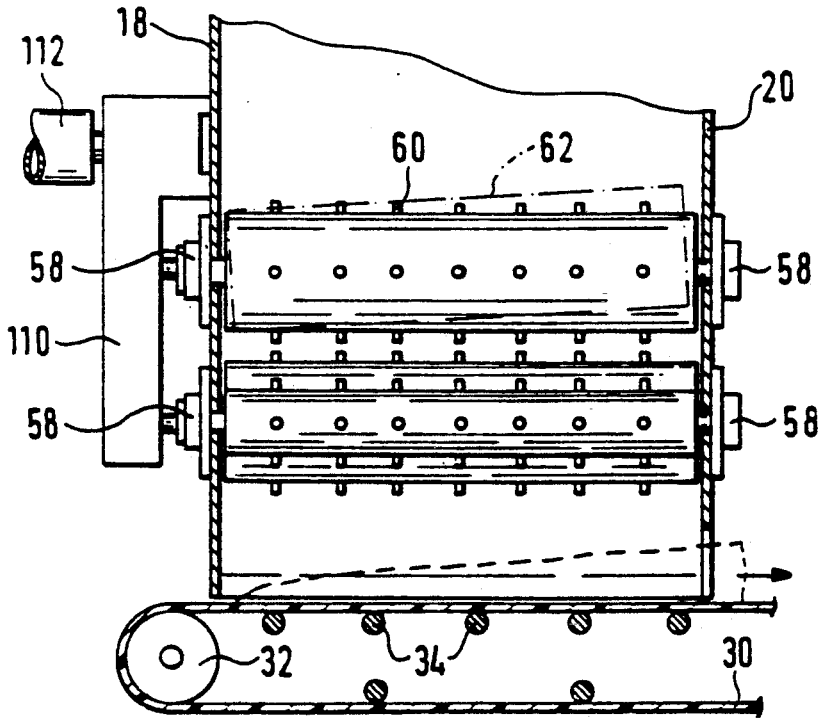
FIG. 2 is a cross-sectional view of the bin or hopper shown in FIG. 1 taken along line II—II of FIG. 1.

Material sifted from the retention area 26 by discharge apparatus 12 falls through discharge area 28 onto conveyor 16. The conveyor shown in FIGS. 1 and 2 is a belt conveyor having an endless, revolving receiving belt 30 guided by turning rolls at either end, one of which is shown in FIG. 2 and designated with numeral 32. Additionally, idler guide rolls 34 are disposed within the loop defined by the belt 30. It will be understood by those knowledgeable in the art that other types of conveyors such as slat conveyors, augers, or the like may be used beneath the bin 10 for receiving and transporting material therefrom. In some processes, it may be advantageous to provide a loading chute beneath the bin, for transferring material from the bin to trucks, railroad cars, or the like, or, in other operations, it may be advantageous to dispose sizing screens or other process apparatus beneath the bin 10.

As shown in FIGS. 1 and 2, discharge apparatus 12 includes an upper row of rolls 40, 42, 44, and 46; and a lower row of rolls including large outer rolls 48 and 50; and a pair of smaller inner rolls 52 and 54. The lower rolls are positioned to obstruct the flow of material along the paths defined by the upper rolls. Thus, lower roll 48 is positioned in the vertical material flow path generally indicated by arrow 55 and defined by upper rolls 40 and 42, and lower roll 50 is positioned in the vertical material flow path generally indicated by arrow 56 and defined by upper rolls 44 and 46. The pair of small lower rolls 52 and 54 are cooperatively disposed in the vertical material flow path generally indicated by arrow 57 and defined by upper rolls 42 and 44. A single, larger lower roll can be used in place of the pair of smaller lower rolls 52 and 54. For some materials, it may be advantageous to use a number of different size rolls within each row, either upper or lower. Hence, it is not essential, and in some applications perhaps even undesirable for all of the upper rolls to be equal in size. In some situations, it may be advantageous to use more than two rows of rolls, and additional rows can be provided beneath the lower row or above the upper row shown in FIG. 1.

Each of the rolls extend from one side wall of the bin to the opposite side wall, and each is journalled in bearings 58 at either end. Floating bearings can be used advantageously to support the rolls and prevent damage from passage of oversize or hard material through the discharger.

In the embodiment shown in FIGS. 1 and 2, each of the rolls is essentially smooth and cylindrical, and has disposed on the surface thereof a plurality of outwardly extending knobs or cleats 60. The knobs or cleats 60 perform a raking or sifting operation on the material, moving it from the retained area and positioning it for passage through the space between adjacent rolls.

The rolls can be disposed horizontally, or, as shown by the phantom line 62 in FIG. 2, the rolls may be inclined, either front to back or vice versa. The rolls can be disposed between any opposed wall surfaces in the bin or hopper. For example, in a rectangularly shaped bin, shorter rolls can be disposed between the opposed longer walls of the bin, or longer rolls can be disposed between the opposed shorter walls. In some applications, it may be advantageous to position the rolls angularly with respect to the bin walls.

As shown in FIG. 1 by the arrows on each of the rolls, adjacent rolls rotate in opposite directions. This rotational relationship is effective for granular and powderous materials; however, in some applications in which the flow characteristics of the material are different, the rotational pattern of the rolls may be different. While each of the rolls may rotate at the same peripheral speed, it may be advantageous to operate various rolls at different speeds. The ease of flow, angle of repose, size, bulk density, and other characteristics of the material stored in the bin will affect the various alternate arrangements described herein. In this regard, the rolls can each run at constant speeds or at variable speeds.

Figure 3:
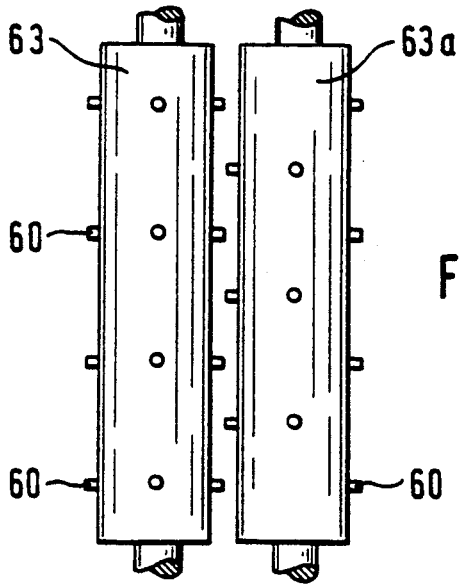
FIG. 3 is a view of 2 adjacent rolls of the discharge apparatus shown in FIGS. 1 and 2.
Figure 4:
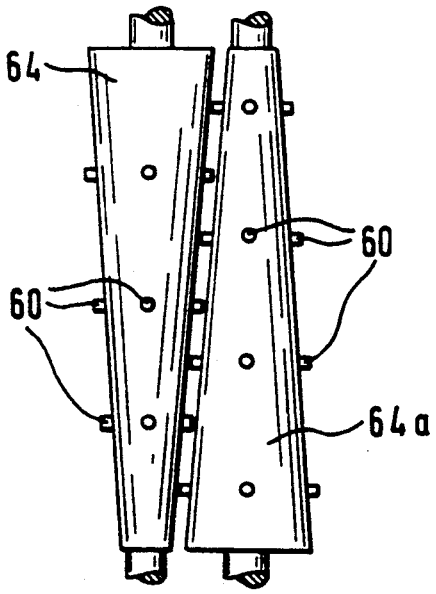
FIG. 4 is a view of a modified embodiment of a roll pair for the discharge apparatus of the present invention.
Figure 5:
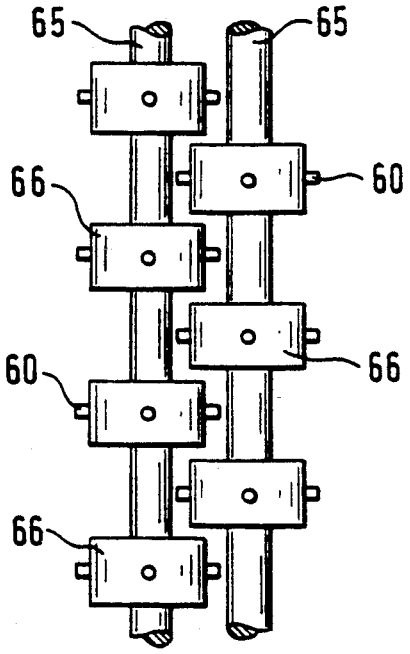
FIG. 5 is a view of another modified embodiment of a roll pair for the present invention.
Figure 6:
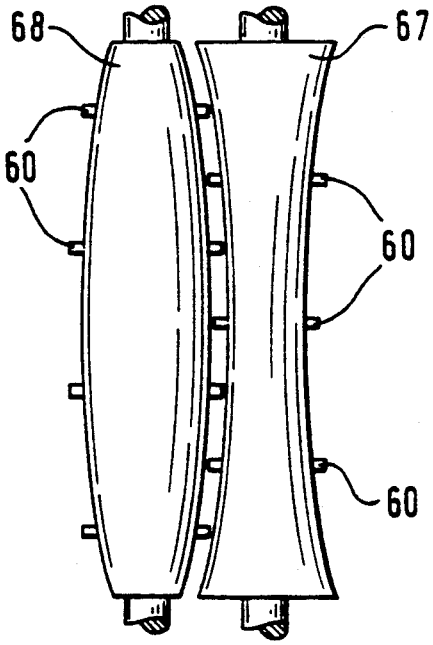
FIG. 6 is a view of yet another modified embodiment of a roll pair for the present invention.

FIG. 3 shows a pair of adjacent rolls 63 and 63*a* for the discharge apparatus depicted in FIG. 1 and 2. As shown, the rolls may be adjacent, either in the horizontal or vertical planes. While substantially cylindrical roll surfaces are shown, it should be recognized that other shapes can be used for the rolls. In FIG. 4, oppositely directed, generally frustoconically shaped rolls 64 and 64*a* are shown. In FIG. 5, interleaved staggered cylinders are shown on adjacent rolls, with each roll including a central portion or shaft 65 and larger cylindrical sections 66. Adjacent sections 66 on a shaft 65 are spaced from each other to accommodate interleaving of sections from adjacent shafts. In FIG. 6, a complimentary concave roll 67, and a convex roll 68 are shown. Each of the rolls is shown having knobs or cleats 60 thereon. It should be recognized that the arrangement pattern, proximity, shape, and length of the knobs or cleats may vary, substantially depending on the characteristics of the material being stored.

Figure 7:
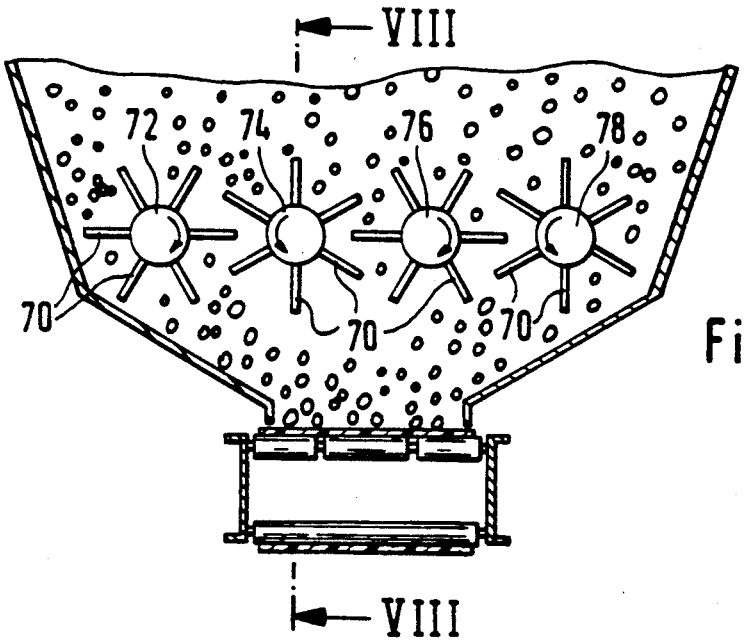
FIG. 7 is a cross-sectional view of a bin having a discharge apparatus of the present invention utilizing a single row of intermeshing rolls.
Figure 8:
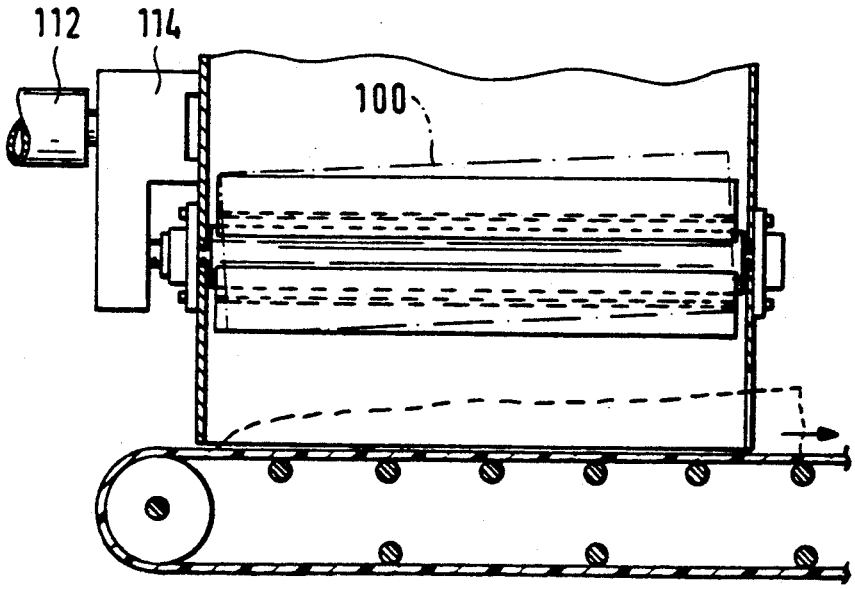
FIG. 8 is a cross-sectional view of the bin and discharge apparatus shown in FIG. 7, taken along line VIII—VIII of FIG. 7.
Figure 9:
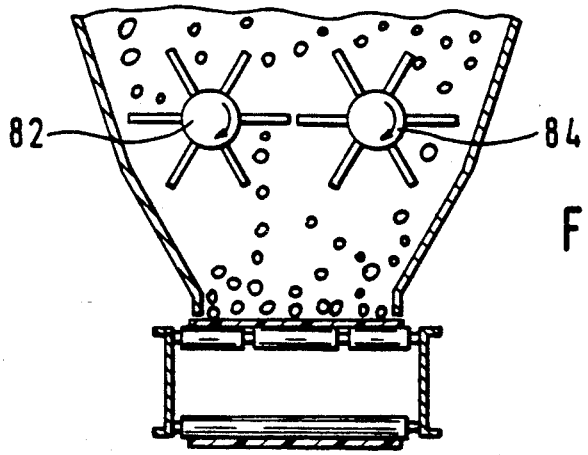
FIG. 9 is a cross-sectional view of a smaller bin utilizing an alternate arrangement of a single row of rolls for the discharge apparatus.
Figure 10:
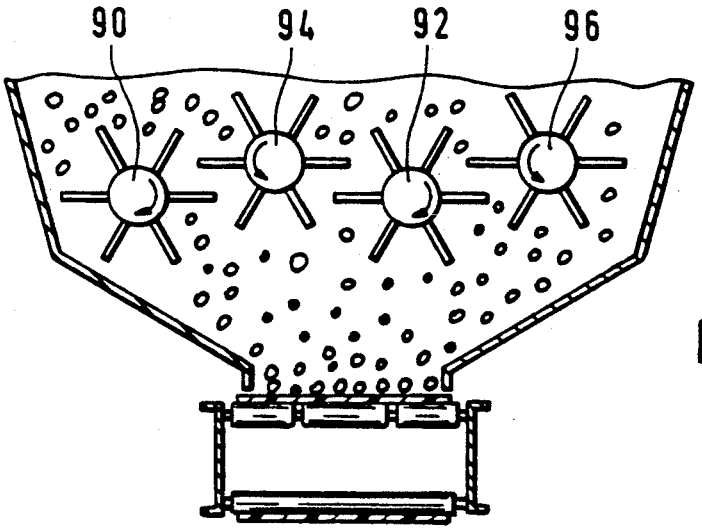
FIG. 10 is a cross-sectional view of yet another embodiment of the discharge apparatus of the present invention in a bin or hopper.

In FIGS. 7 through 10, a modified embodiment of the rotating rolls is shown, in which each of the rolls includes a plurality of radially extending projections or plates 70. The plates 70 may extend continuously along the length of the roll, or may be sporadically placed thereon, with plates of adjacent rolls interleaving. The relatively long projections or plates 70 are particularly suitable for applications in which a single row of rolls is disposed along the bottom of the bin. In FIGS. 7 and 8, four rolls 72, 74, 76, and 78 are shown, with the projections or plates 70 extending the length of each roll. Adjacent plates 70 on a single roll define pocket areas 80 around the roll. As shown, each roll includes 6 plates 70, defining 6 pockets on each roll. The number of plates on each roll, and the number of pockets defined thereby may vary. As shown in FIG. 7, the rotor pockets 80 of adjacent rolls interleave, such that a plate of defined by the other roll. In FIG. 9, rolls 82 and 84 are positioned such that only minimal clearance is provided between tips of the projections or plates 70, and the pockets defined by the plates do not interleave. In FIG. 10, rolls 90 and 92, at a slightly higher position, are shown disposed with rolls 94 and 96, operating at a slightly higher position. Again, the pockets 80 defined by the plates 70 of each roll interleave with the pockets of adjacent rolls.

The rotational direction of the rolls of any of the embodiments except the interleaved plate embodiments may be the same or opposite. For discharging some types of material subject to compacting, it is advantageous to rotate all rolls in the same direction, and periodically reverse the direction of rotation to relieve pinching or wedging of material near nonrotating surfaces, such as bin walls. The interleaved plates or pockets must have adjacent rolls rotating in opposite directions. As with the previous embodiments, the rolls may be installed longitudinally, perpendicularly, or even angularly with respect to the longitudinal extent of the hopper or bin. The axis of any of the rolls may be horizontal, or, as shown by phantom line 100 in FIG. 8, the rolls may be inclined, either front-to-back or back-to-front.

The rotational speed of the rotors in any of the embodiments influences the discharge rate of material through the apparatus. Where metering of material is required, the interlaced rotors are most effective in controlling free-flow and capturing regular, discrete volumes of material for discharge. The interlaced pockets of rolls having long, radially extending plates 70 such as those shown in FIGS. 7 and 10 physically prevent the material from moving downwards inside the hopper under action of gravity when the rolls are not being turned. Thus, for granular, powdery or other free-flowing materials, the interleaved pockets act as an effective and accurate metering device.

As shown in FIG. 2, an appropriate drive train 110 is provided for rotating each of the rolls, with the drive train 110 being connected to a rotational drive source 112. A similar drive train 114 is shown in FIG. 8 for rotating the single row or rolls, also connected to a rotational drive source 112. The type of drive train required, rotational power source, and the like will be familiar to those versed in the art, and will not be described in further detail herein.

In the use and operation of a discharge apparatus embodying the present invention, material is loaded into the bin or hopper for storage, and falls, by gravity, to the bottom of the retention area 26. so long as the rolls of the discharge apparatus are not rotated, the material will not fall from the bin or hopper. The shape and arrangement of the rolls, the type of knobs or projections used thereon, etc., are selected depending on the type and characteristics of material being stored. The selection is such that the slope of the path imposed by the rolls is less than the internal angle of repose of the material, thereby inhibiting gravitational flow from the hopper.

When it is desired to remove material from the bin or hopper, the rotational drive source 12 is activated and the drive train transfers power to each of the driven rolls of the discharger. As the rolls are rotated, the material is dislodged from the bottom of the retention area 26 and flows between the rolls, through the discharge area 28, and into the conveyor 16. The material is transported by the conveyor to the desired location. When rotation of the rolls is stopped, free-flow of material from the bin is obstructed by the rolls. For interleaved pocket designs, essentially the entire bin outlet is physically closed.

While particularly suitable for nonfree-flowing materials such as wood chips, the present discharge apparatus will also work well for granular or powder materials. Rotational speed of the rolls influences the discharge rate of the apparatus, and effective metering of the outflow of material from the bin can be performed without causing compaction or bridging. Essentially, all of the material freed from the retention area 26 flows from the bin or hopper, and metering is effected by the rate at which the rolls extract material from the discharge area. With the apparatus covering a large area and providing a bottom for the retention area in a substantially unrestricted portion of the bin, bridging of the material above the discharge apparatus is not a problem.

While several embodiments of a discharge apparatus embodying the present invention have been shown and described in detail herein, various changes may be made without departing from the scope of the present invention, as defined by the following claims.

I claim:

1. A discharge apparatus including a bin, said apparatus comprising:

a plurality of rolls adjacently disposed in the lower portion of the bin, said plurality of rolls including an upper row of rolls and a lower row of rolls, said rolls dividing the bin into a retention area above the upper row of rolls and a discharge area below the lower row of rolls, with said rolls of said lower row of rolls being disposed substantially centrally along, or symmetrically of, a vertical path between spaces defined by adjacent ones of said upper row of rolls, and inhibiting gravitational passage of material from said retention area to said discharge area;

the lower row of rolls arrayed in spaced adjacency substantially across the discharge area, said rolls in the lower row also being spaced from rolls in the upper row;

means defining projections on the surfaces of said rolls for agitating materials stored in said bin and resting against said rolls; and drive means connected to said rolls for rotating said rolls and agitating material stored in said bin for encouraging gravitational flow of material between said rolls from said retention area to said discharge area, said drive means operatively connected to said upper and lower rows of rolls in such a manner as to rotate the upper and lower rows of rolls differently.

2. A discharge apparatus, as recited in claim 1, wherein:

horizontally adjacent rolls in at least one of said upper or lower rows of rolls are connected to said drive means for rotation in opposite directions each roll relative to an adjacent roll in the same row.

3. A discharge apparatus, as recited in claim 1, wherein:

adjacent rolls in the upper and lower rows of rolls rotate in opposite directions.

4. A discharge apparatus, as recited in claim 1, wherein:

at least some of the rolls in the upper row of rolls rotate in a direction opposite to at least some of the rolls in the lower row of rolls.

* * * * *

UNITED STATES PATENT AND TRADEMARK OFFICE

CERTIFICATE OF CORRECTION

PATENT NO. : 5,176,295

DATED : January 5, 1993

INVENTOR(S) : Paul Stefanik

It is certified that error appears in the above-indentified patent and that said Letters Patent is hereby corrected as shown below:

Column 5, Line 12: Before "defined", please insert --each adjacent roll will project partially into the pocket--

Signed and Sealed this

Twenty-sixth Day of October, 1993

*Attest:*

*Attesting Officer*

BRUCE LEHMAN

*Commissioner of Patents and Trademarks*